US009503798B2

(12) United States Patent
Lee

(10) Patent No.: US 9,503,798 B2
(45) Date of Patent: Nov. 22, 2016

(54) WATER DANCING SPEAKER

(71) Applicant: ATAKE DIGITAL TECHNOLOGY (SHENZHEN) CO., LTD., Shenzhen, Guangdong Province (CN)

(72) Inventor: Kuo-Tsai Lee, Shenzhen, Guangdong Province (CN)

(73) Assignee: ATAKE DIGITAL TECHNOLOGY (SHENZHEN) CO., LTD., Shenzhen, Guangdong Province (CN)

( * ) Notice: Subject to any disclaimer, the term of this patent is extended or adjusted under 35 U.S.C. 154(b) by 16 days.

(21) Appl. No.: 14/622,820

(22) Filed: Feb. 13, 2015

(65) Prior Publication Data

US 2016/0212514 A1 Jul. 21, 2016

(30) Foreign Application Priority Data

Jan. 19, 2015 (CN) ..... 2015 1 0026497

(51) Int. Cl.

| | |
|---|---|
| ***H04R 9/06*** | (2006.01) |
| ***H04R 1/02*** | (2006.01) |
| ***B05B 9/03*** | (2006.01) |
| ***B05B 1/16*** | (2006.01) |
| ***B05B 1/34*** | (2006.01) |
| ***B05B 12/04*** | (2006.01) |

(52) U.S. Cl.
CPC ..... *H04R 1/028* (2013.01); *B05B 1/169* (2013.01); *B05B 1/34* (2013.01); *B05B 9/03* (2013.01); *B05B 12/04* (2013.01)

(58) Field of Classification Search
CPC ..... H04R 1/028
USPC ..... 381/334; 362/101
See application file for complete search history.

(56) References Cited

U.S. PATENT DOCUMENTS

| | | | | |
|---|---|---|---|---|
| 6,135,604 | A * | 10/2000 | Lin | B44F 1/08 119/254 |
| 7,905,728 | B2 * | 3/2011 | Piontek | G09B 23/12 366/273 |
| 2001/0018621 | A1 * | 8/2001 | Weikel | H04R 3/14 700/94 |
| 2010/0079370 | A1 * | 4/2010 | Kim | G06F 3/011 345/156 |
| 2013/0186346 | A1 * | 7/2013 | Milford | A01K 63/06 119/247 |
| 2014/0003036 | A1 * | 1/2014 | Ho | F21S 10/002 362/101 |
| 2014/0204565 | A1 * | 7/2014 | Zwierstra | A45C 15/06 362/101 |

* cited by examiner

*Primary Examiner* — Paul S Kim
*Assistant Examiner* — Katherine Faley
(74) *Attorney, Agent, or Firm* — Cheng-Ju Chiang

(57) ABSTRACT

A water dancing speaker is disclosed. The water dancing speaker comprises a housing assembly, a liquid spraying device, a driving device and an audio device. The housing assembly comprises an upper housing and a lower housing connected with each other, the upper housing is made of a transparent material, an end cover is disposed on the top of the upper housing, the end cover is capable of being opened relative to the top of the upper housing to inject a liquid into the upper housing; and the liquid spraying device, the driving device and the audio device are disposed within the housing assembly. The water dancing speaker of the present disclosure, the users can add an appropriate amount of liquid or other substances capable of improving the ornamental effect into the speaker according to their own preferences, and this improves the ornamental value of the water dancing speakers.

8 Claims, 5 Drawing Sheets

WATER DANCING SPEAKER

CROSS-REFERENCE OF RELATED APPLICATIONS

This present application is related to U.S. patent application Ser. No. 14/614,384, entitled, "WATER DANCING SPEAKER", filed Feb. 4, 2015, which has been issued as U.S. Pat. No. 9,278,369B2. The disclosure of the above mentioned patent application is hereby incorporated by reference in its entirety.

FIELD OF THE INVENTION

The present disclosure generally relates to the technical field of speaker, and more particularly, to a water dancing speaker.

BACKGROUND OF THE INVENTION

In addition to the function of playing music, the existing speakers also have some additional ornamental structures, e.g., a structure for presenting a visual effect of water dancing. However, the water dancing speakers of the prior art mainly have the following drawbacks: 1. shapes and functions thereof are relatively simple, and the fountain spraying device thereof can only spray liquid columns of a single style upwardly in response to the change of music rhythms, so the fountain spraying effect is unsatisfactory and the ornamental value is insufficient; 2. the part thereof for containing the liquid is generally an integrally sealed structure that cannot be opened, so users cannot add an appropriate amount of liquid or other substances capable of improving the ornamental effect into the speakers according to their own preferences, and this makes the water dancing speakers of the prior art have a poor adaptability.

SUMMARY OF THE INVENTION

Embodiments of the present invention provides a water dancing speaker to solve the aforesaid technical problems in the prior art that the shapes and the style of the liquid columns are relatively simple and the adaptability of the speakers is poor because the users cannot add an appropriate amount of liquid or other substances capable of improving the ornamental effect into the speakers according to their own preferences.

To solve the aforesaid technical problems, the embodiments of the present disclosure provide a water dancing speaker which comprises a housing assembly, a liquid spraying device, a driving device and an audio device. The housing assembly comprises an upper housing and a lower housing connected with each other, the upper housing is made of a transparent material, an end cover is disposed on the top of the upper housing, the end cover is capable of being opened relative to the top of the upper housing to inject a liquid into the upper housing; and the liquid spraying device, the driving device and the audio device are disposed within the housing assembly.

According to a preferred embodiment of the present disclosure, colored ornaments are also injected into the upper housing after the liquid is injected into the upper housing.

According to a preferred embodiment of the present disclosure, the colored ornaments are colored resin balls, the colored resin balls become larger in volume and suspend in the liquid within the upper housing after absorbing the liquid within the upper housing, and the liquid spraying device drives the liquid within the upper housing to produce a liquid flow motion so that the colored resin balls move accordingly.

According to a preferred embodiment of the present disclosure, a sealing ring for mating with the end cover is further disposed on the top of the upper housing, and the end cover is openably connected to the top of the upper housing through the sealing ring.

According to a preferred embodiment of the present disclosure, the end cover further comprises a side wall, a top wall, a recessed portion and a clamping portion, the top wall is formed integrally with the side wall, the recessed portion is disposed at an outer side of a middle part of the top wall, and the clamping portion integrally extends from an inner side of the top wall.

According to a preferred embodiment of the present disclosure, the sealing ring comprises a vertical portion, a horizontal portion, a projecting portion and a clamping groove. The horizontal portion is disposed at a top end of the vertical portion and shaped as an annular plate, an outline of the horizontal portion conforms to an inner circumference of the side wall of the end cover to achieve the mating between the end cover and the sealing ring, the projecting portion is connected integrally with the vertical portion, the clamping groove is formed between the projecting portion and the vertical portion, the clamping portion is inserted into the clamping groove to be clamped to and mate with the clamping groove, the size of the periphery of the vertical portion fits with the size of an inner wall of the top end of the upper housing, and the vertical portion is clamped to and mates with the inner wall of the top end of the upper housing.

According to a preferred embodiment of the present disclosure, the water dancing speaker has one or more groups of the liquid spraying device, the driving device and the audio device disposed therein.

According to a preferred embodiment of the present disclosure, the liquid spraying device further comprises from top to bottom a sprayer shading plate, a sprayer plate, a sprayer base and a colored lighting plate that are connected together in sequence, sprayers for liquid spraying are disposed on and protrude from the sprayer plate, the sprayer shading plate is provided with through holes at positions corresponding to the sprayers from which the sprayers protrude respectively, colored lights are installed on the colored lighting plate at positions corresponding to the sprayers, and the sprayer base is provided with through holes at positions corresponding to the colored lights through which the light of the colored lights passes; the driving device comprises a driving motor, a first magnet and a rotating blade, the first magnet is installed on an output shaft of the driving motor, the rotating blade has a second magnet disposed therein, the driving motor drives the first magnet to rotate, and a magnetic force generated between the first magnet and the second magnet drives the rotating blade to rotate so that the liquid is sprayed to the outside from the sprayer base through a liquid outlet and a liquid flow channel.

According to a preferred embodiment of the present disclosure, the water dancing speaker further comprises a liquid column steering device disposed within the lower housing, the driving device drives, via the magnetic force, the rotating blade and the liquid column steering device to operate so that the liquid spraying device generates a rotating liquid column; the liquid column steering device comprises a link and a driving gear and a driven gear that engage with each other, one end of the link is pivoted to the driven gear while the other end thereof is pivoted to a liquid-delivery case cover, a magnet is disposed within the driving gear, and the driving device drives the driving gear to rotate via a magnetic force generated therebetween.

According to a preferred embodiment of the present disclosure, the water dancing speaker further comprises a blowing control unit for adjusting the volume and/or luminance of the water dancing speaker.

As compared to the prior art, the water dancing speaker according to the present disclosure has an opening disposed on the housing, so the users can add an appropriate amount of liquid or other substances capable of improving the ornamental effect into the speaker according to their own preferences, and this improves the ornamental value and the adaptability of the water dancing speakers; and moreover, the liquid columns are driven by the liquid column steering device to rotate in the horizontal direction so as to generate a wiggly fountain spraying effect. Together with the changing light rays, a dynamic and colorful dancing effect is presented, and this remarkably improves the ornamental value of the speaker, i.e., a water dancing speaker with individualized functions is provided.

BRIEF DESCRIPTION OF THE DRAWINGS

To describe the technical solutions of embodiments of the present disclosure more clearly, the attached drawings necessary for description of the embodiments will be introduced briefly hereinbelow. Obviously, these attached drawings only illustrate some of the embodiments of the present disclosure, and those of ordinary skill in the art can further obtain other attached drawings according to these attached drawings without making inventive efforts.

FIG. 3 is a schematic structural view of an end cover in the embodiment of FIG. 1;

FIG. 4 is a schematic structural view of a sealing ring in the embodiment of FIG. 1;

DETAILED DESCRIPTION OF THE INVENTION

Hereinbelow, the present disclosure will be further detailed with reference to the attached drawings and embodiments thereof. It shall be particularly noted that, the following embodiments are only for the purpose of illustration but are not intended to limit the scope of the present disclosure. Similarly, the following embodiments are only some of but not all of the embodiments of the present disclosure, and all other embodiments that can be devised without making inventive efforts by those of ordinary skill in the art shall fall within the scope of the present disclosure.

Figure 1:
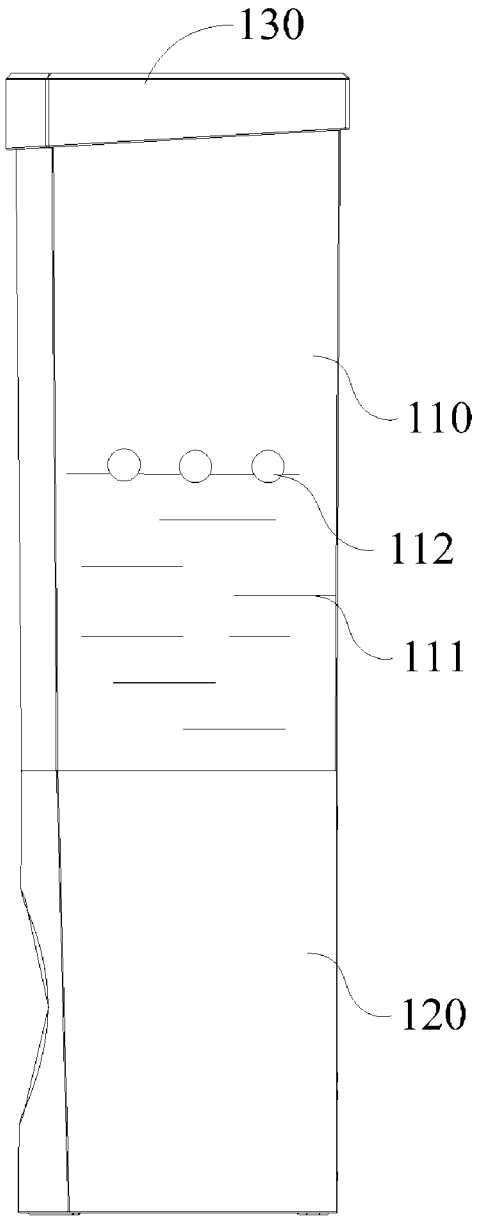
FIG. 1 is an overall schematic structural view of a water dancing speaker according to a preferred embodiment of the present disclosure.
Figure 2:
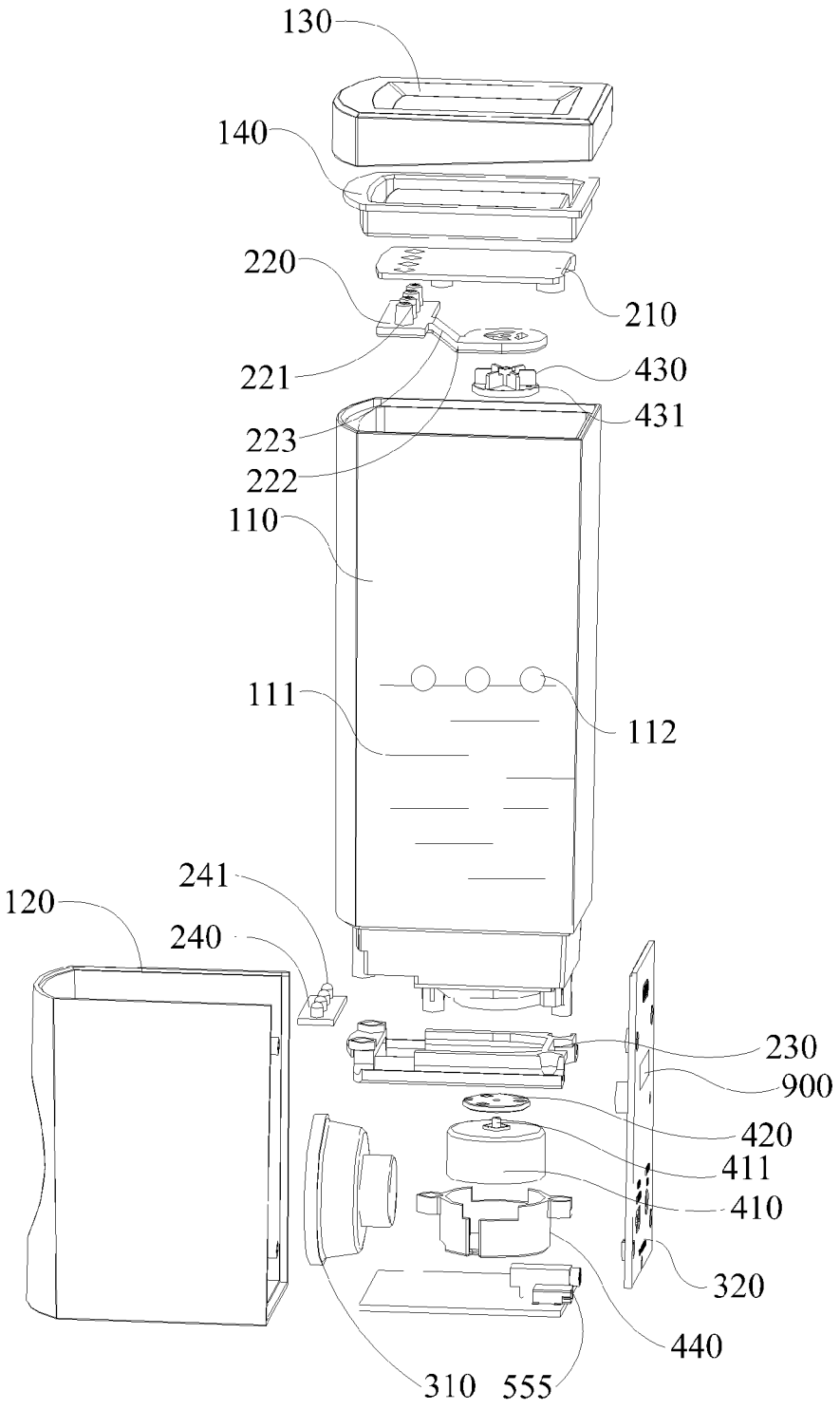
FIG. 2 is an exploded structural view of the water dancing speaker in the embodiment of FIG. 1.

Referring to FIG. 1 and FIG. 2 together, FIG. 1 is an overall schematic structural view of a water dancing speaker according to a preferred embodiment of the present disclosure, and FIG. 2 is an exploded structural view of the water dancing speaker in the embodiment of FIG. 1. The water dancing speaker comprises a housing assembly, a liquid spraying device and an audio device.

Specifically, the housing assembly comprises an upper housing 110 and a lower housing 120 connected with each other, and the upper housing 110 may be specifically clamped to the lower housing 120. Preferably, the upper housing 110 is made of a transparent material, an end cover 130 is disposed on the top of the upper housing 110, the end cover 130 is capable of being opened relative to the top of the upper housing 110 to inject a liquid 111 into the upper housing 110. The liquid 111 injected into the upper housing 110 may be water or oil.

Preferably, a sealing ring 140 for mating with the end cover 130 is further disposed on the top of the upper housing 110, and the end cover 130 is openably connected to the top of the upper housing 110 through the sealing ring 140. The shape of the sealing ring 140 conforms to the outline of the upper housing 110, and the sealing ring 140 may be made of a rubber material although no limitation is made thereto.

Figure 3A:
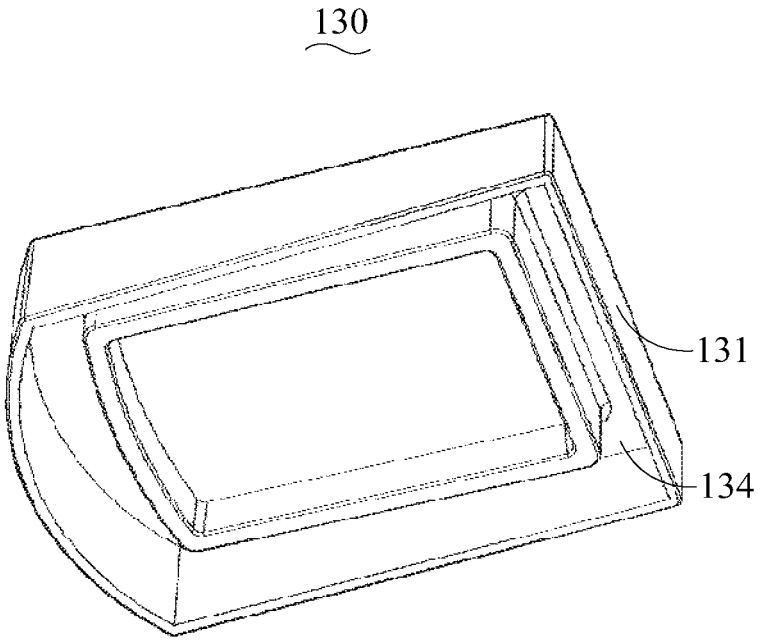
FIG. 3A is a schematic structural view of the bottom of the end cover of FIG. 3.

Referring to FIG. 3, FIG. 3A and FIG. 4 together, FIG. 3 is a schematic structural view of an end cover in the embodiment of FIG. 1, FIG. 3A is a schematic structural view of the bottom of the end cover of FIG. 3 and FIG. 4 is a schematic structural view of a sealing ring in the embodiment of FIG. 1. The end cover 130 further comprises a side wall 131, a top wall 132, a recessed portion 133 and a clamping portion 134, and the sealing ring 140 comprises a vertical portion 141, a horizontal portion 142, a projecting portion 143 and a clamping groove 144.

The top wall 132 is formed integrally with the side wall 131, the recessed portion 133 is disposed at an outer side of a middle part of the top wall 132 (on an upper surface of the top wall 132), the clamping portion 134 integrally extends from an inner side of the top wall (from a lower surface of the top wall 132), and the clamping portion 134 is inserted into the clamping groove 144 to be clamped to and mate with the clamping groove 144. The horizontal portion 142 is disposed at a top end of the vertical portion 141 and shaped as an annular plate, an outline of the horizontal portion 142 conforms to an inner circumference of the side wall 131 of the end cover 130 to achieve the mating between the end cover 130 and the sealing ring 140, the projecting portion 143 is connected integrally with the vertical portion 141, and the clamping groove 144 is formed between the projecting portion 143 and the vertical portion 141. The size of the periphery of the vertical portion 141 fits with the size of an inner wall of the top end of the upper housing 110, and the vertical portion 141 is clamped to and mates with the inner wall of the top end of the upper housing 110.

The users can add different amounts of liquid 111 into the upper housing 110 according to their own preferences. When a small amount of liquid 111 is added, an effect of spraying a liquid column can be produced by the water dancing speaker; and when a large amount of liquid 111 is added, colored ornaments 112 may be further added into the upper housing 110. The colored ornaments 112 may be colored resin balls, and the colored resin balls become larger in volume and suspend in the liquid 111 within the upper housing 110 after absorbing the liquid 111 within the upper housing. The liquid spraying device drives the liquid within the upper housing 110 to produce a liquid flow motion so that the colored resin balls move accordingly. Together with the changing light rays, a dynamic and colorful dancing effect is presented.

The liquid spraying device is disposed within the lower housing 120 and is adapted to produce liquid columns that vary rhythmically with the audio characteristics of the played tracks, and the liquid columns may be pure and transparent liquid columns or colored liquid columns, and no limitation is made thereto.

The liquid spraying device further comprises from top to bottom a sprayer shading plate 210, a sprayer plate 220, a sprayer base 230 and a colored lighting plate 240 that are connected together in sequence.

The sprayer shading plate 210 is made of an opaque material, and both the sprayer plate 220 and the sprayer base 230 are made of a transparent material. Of course, the sprayer plate 220 and the sprayer base 230 may also be made of an opaque material. Sprayers 221 for liquid spraying are disposed on and protrude from the sprayer plate 220, and a central position of each of the sprayers 221 is provided with a liquid spraying hole running through the sprayer plate 220. The sprayer shading plate 210 is provided with through holes at positions corresponding to the sprayers 221 from which the sprayers 221 protrude respectively. Moreover, colored lights 241 are installed on the colored lighting plate 240 at positions corresponding to the sprayers 221.

In this embodiment, the colored lights 241 are preferably LED colored lights, and the sprayer base 230 is provided with through holes at positions corresponding to the colored lights 241 through which the light of the colored lights 241 passes. Thus, the light emitted from the colored lights 241 can pass through the sprayer base 230, the sprayer plate 220 and the sprayer shading plate 210 sequentially and propagate into the upwardly sprayed liquid columns. Then, changing light beams are formed by virtue of the refraction effect of the liquid columns to further present a dynamic and colorful dancing effect, which improves the ornamental value of the speaker remarkably. It shall be appreciated that, the number of the sprayers 221 may be determined depending on practical needs as long as the number of the through holes on the sprayer shading plate 210 corresponds to the number of the sprayers 221, and no limitation is made thereto.

The audio device may comprise a loudspeaker 310, a circuit board 320 and a Bluetooth module (not shown), and the circuit board 320 is electrically connected to the loudspeaker 310, the Bluetooth module and the colored lighting plate 240. The Bluetooth module is adapted to be connected with a corresponding sound device (e.g., a mobile phone, a tablet computer, etc.) to play the music. The loudspeaker 310 is fixedly installed within the lower housing 120 and corresponds to a sound outlet thereof, and the circuit board 320 may be a PCB board and is installed within the lower housing 120. The water dancing speaker further comprises structures such as a power interface and an audio interface 555. Moreover, the Bluetooth module may also be integrated on the circuit board 320 to simplify the electrically controlling structure of the water dancing speaker.

The driving device comprises a driving motor 410, a first magnet 420 and a rotating blade 430, the first magnet 420 is installed on an output shaft 411 of the driving motor 410, the rotating blade 430 has a second magnet 431 disposed therein, the driving motor 410 drives the first magnet 420 to rotate, and a magnetic force generated between the first magnet 410 and the second magnet 431 drives the rotating blade 430 to rotate so that the liquid 111 is sprayed to the outside from the sprayer base 230 through a liquid outlet 222 and a liquid flow channel 223. The driving device further comprises a driving motor mounting support 440 for installing and fixing the driving motor 410.

Figure 4A:
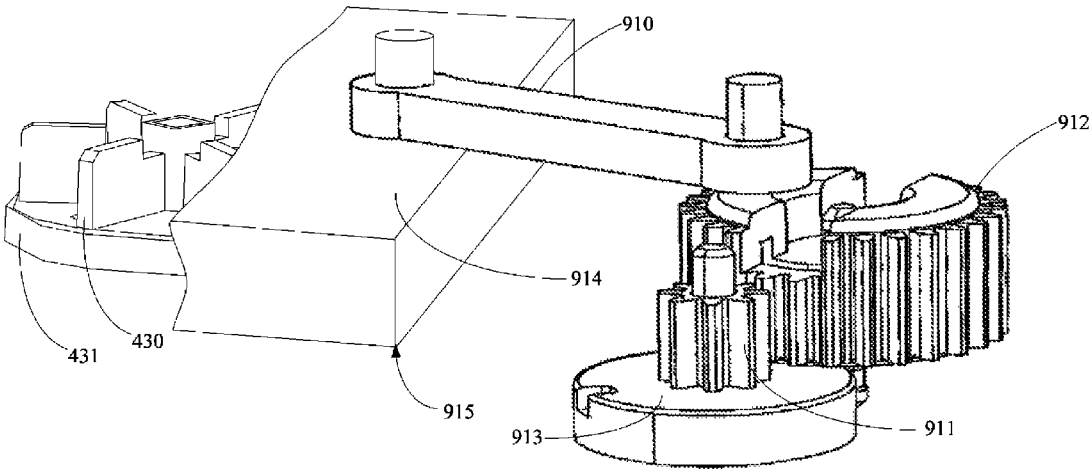
FIG. 4A is a schematic structural view of a liquid column steering device according to another preferred embodiment of the present disclosure.

Referring to FIG. 4A, FIG. 4A is a schematic structural view of a liquid column steering device according to another preferred embodiment of the present disclosure. Furthermore, the liquid spraying device may further comprise a liquid-delivery case 915 and a liquid-delivery case cover 914 to contain the to be sprayed liquid 111. The rotating blade 430 is installed within the liquid-delivery case 915.

Further speaking, the water dancing speaker may further comprise a liquid column steering device that is disposed within the lower housing 120. The driving device drives, via a magnetic force, the liquid column steering device to operate so that the liquid spraying device generates a rotating liquid column.

The liquid column steering device comprises a link 910 and a driving gear 911 and a driven gear 912 that engage with each other, and stationary shafts are disposed at corresponding positions within the lower housing 120 to install the driving gear 911 and the driven gear 912 respectively. One end of the link 910 is pivoted to the driven gear 912 while the other end thereof is pivoted to the liquid-delivery case cover 914 so that a crank-link mechanism is formed. A magnet 913 is disposed within the driving gear 911, and the driving device drives, via a magnetic force, the driving gear 911 to rotate so that the liquid columns sprayed through the sprayers 221 are sloped to generate various dancing effects.

In a preferred embodiment, an eccentric first fixing pillar is disposed on and protrudes from the driven gear 912, an eccentric second fixing pillar is disposed on and protrudes from the liquid-delivery case cover 914, the two ends of the link are provided with through holes for fitting with the first fixing pillar and the second fixing pillar respectively, and the two ends of the link 910 are nested onto the first fixing pillar and the second fixing pillar respectively via the through holes thereon.

Of course, the technical feature of this embodiment that an end cover is disposed on the housing and is capable of being opened relative to the housing so that the users can add a certain amount of liquid 111 or colored ornaments 112 into the housing according to their own preferences may also be applied to water dancing speakers of other structures instead of being limited to the speaker structure described in this embodiment. This is within the understanding of those skilled in the art and thus will not be enumerated herein.

More preferably, the water dancing speaker may further comprise a blowing control unit 900 for adjusting the volume and/or luminance of the water dancing speaker. In structure, the blowing control unit 900 is specifically a plurality of blowing control microphones disposed on the periphery of the housing. When changes in the nearby airflow are sensed by the blowing control microphones, the changes in the nearby airflow are transformed by the blowing control microphones into an electrical signal so that the circuit board transmits a controlling instruction to control corresponding operations. The plurality of blowing control microphones may correspond to different controlling instructions respectively.

The water dancing speaker according to the embodiments of the present disclosure has an opening disposed on the housing so that the users can add an appropriate amount of liquid 111 or other substances capable of improving the ornamental effect into the speaker according to their own preferences, and this improves the ornamental value of the water dancing speakers and provides the users with individualized experiences. Moreover, the liquid columns are driven by the liquid column steering device to rotate in the horizontal direction so as to generate the wiggly fountain spraying effect. Together with the changing light rays, a dynamic and colorful dancing effect is presented, and this remarkably improves the ornamental value of the speaker.

Figure 5:
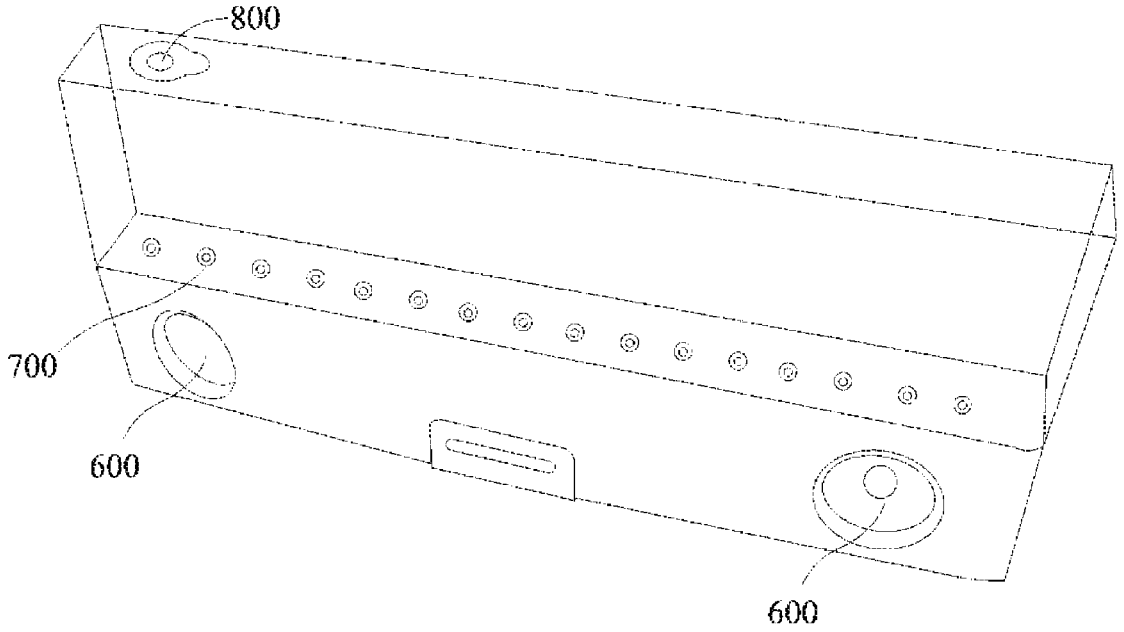
FIG. 5 is an overall schematic structural view of a water dancing speaker according to another preferred embodiment of the present disclosure.

Referring to FIG. 5, FIG. 5 is an overall schematic structural view of a water dancing speaker according to another preferred embodiment of the present disclosure. The water dancing speaker of this embodiment is shaped as a long strip as a whole and comprises two groups of audio devices that are specifically shown as two loudspeakers 600 in FIG. 5. Other structural features within the housing are not shown. A plurality of sprayers 700 of the water dancing speaker are arranged on the bottom of the upper housing at equal intervals. To enhance the liquid spraying strength, several groups of liquid spraying devices and driving devices may be provided and are also arranged within the lower housing uniformly, and this will not be further described herein. An end cover 800 is disposed on the top of the upper housing, but differs from that of the previous embodiment in that, the aperture of the end cover 800 is smaller than that of the top of the upper housing. The end cover 800 can also be opened relative to the top of the upper housing so that the users can add liquids and/or colored ornaments 112 into the upper housing according to their own preferences. The resulting effect and specific structures are the same as those of the previous embodiment, so the technical features thereof will not be further described herein.

Of course, it shall be noted that, the shape of the housing of the water dancing speaker according to the present disclosure is not limited to the two kinds described in the aforesaid embodiments and it may be any shapes such as a loop, a cylinder, a rhombus, etc. Moreover, several groups of liquid spraying devices, driving devices and audio devices may be provided depending on specific shapes and requirements for power and for the speaker effect. This is within the understanding of those skilled in the art and thus will not be enumerated herein.

What described above are only the embodiments of the present disclosure, but are not intended to limit the scope of the present disclosure. Any equivalent structures or equivalent process flow modifications that are made according to the specification and the attached drawings of the present disclosure, or any direct or indirect applications of the present disclosure in other related technical fields shall all be covered within the scope of the present disclosure.

What is claimed is:

1. A water dancing speaker, comprising a housing assembly, a liquid spraying device, a driving device and an audio device, wherein the housing assembly comprises an upper housing and a lower housing connected with each other, the upper housing is made of a transparent material, an end cover is disposed on the top of the upper housing, the end cover is capable of being opened relative to the top of the upper housing to inject a liquid into the upper housing; and the liquid spraying device, the driving device and the audio device are disposed within the housing assembly;

wherein colored ornaments are also injected into the upper housing after the liquid is injected into the upper housing; wherein the colored ornaments are colored resin balls, the colored resin balls become larger in volume and suspend in the liquid within the upper housing after absorbing a portion of the liquid within the upper housing, and the liquid spraying device drives the liquid within the upper housing to produce a liquid flow motion so that the colored resin balls move accordingly.

2. The water dancing speaker of claim 1, wherein a sealing ring for mating with the end cover is further disposed on the top of the upper housing, and the end cover is openably connected to the top of the upper housing through the sealing ring.

3. The water dancing speaker of claim 2, wherein the end cover further comprises a side wall, a top wall, a recessed portion and a clamping portion; the top wall is formed integrally with the side wall, the recessed portion is disposed at an outer side of a middle part of the top wall, and the clamping portion integrally extends from an inner side of the top wall.

4. The water dancing speaker of claim 3, wherein the sealing ring comprises a vertical portion, a horizontal portion, a projecting portion and a clamping groove; the horizontal portion is disposed at a top end of the vertical portion and shaped as an annular plate, an outline of the horizontal portion conforms to an inner circumference of the side wall of the end cover to achieve the mating between the end cover and the sealing ring, the projecting portion is connected integrally with the vertical portion, the clamping groove is formed between the projecting portion and the vertical portion, the clamping portion is inserted into the clamping groove to be clamped to and mate with the clamping groove, the size of the periphery of the vertical portion fits with the size of an inner wall of the top end of the upper housing, and the vertical portion is clamped to and mates with the inner wall of the top end of the upper housing.

5. The water dancing speaker of claim 1, wherein the water dancing speaker has one or more groups of the liquid spraying device, the driving device and the audio device disposed therein.

6. The water dancing speaker of claim 5, wherein the liquid spraying device further comprises from top to bottom a sprayer shading plate, a sprayer plate, a sprayer base and a colored lighting plate that are connected together in sequence, sprayers for liquid spraying are disposed on and protrude from the sprayer plate, the sprayer shading plate is provided with through holes at positions corresponding to the sprayers from which the sprayers protrude respectively, colored lights are installed on the colored lighting plate at positions corresponding to the sprayers, and the sprayer base is provided with through holes at positions corresponding to the colored lights through which the light of the colored lights passes; the driving device comprises a driving motor, a first magnet and a rotating blade, the first magnet is installed on an output shaft of the driving motor, the rotating blade has a second magnet disposed therein, the driving motor drives the first magnet to rotate, and a magnetic force generated between the first magnet and the second magnet drives the rotating blade to rotate so that the liquid is sprayed from the sprayer base through a liquid outlet and a liquid flow channel.

7. The water dancing speaker of claim 6, further comprising a liquid column steering device disposed within the lower housing, the driving device drives, via the magnetic force, the rotating blade and the liquid column steering device to operate so that the liquid spraying device generates a rotating liquid column; the liquid column steering device comprises a link and a driving gear and a driven gear that engage with each other, one end of the link is pivoted to the driven gear while the other end thereof is pivoted to a liquid-delivery case cover, a magnet is disposed within the driving gear, and the driving device drives the driving gear to rotate via a magnetic force generated therebetween.

8. The water dancing speaker of claim 1, further comprising a blowing control unit for adjusting the volume and/or luminance of the water dancing speaker.

* * * * *